United States Patent [19]

Reiners et al.

[11] 4,195,790

[45] Apr. 1, 1980

[54] METHOD AND DEVICE FOR DISCONTINUING OPERATION OF A WINDING DEVICE AFTER A THREAD BREAK OCCURS

[75] Inventors: Franz-Josef Reiners, Ratheim; Wilhelm Maasen, Mönchen-Gladbach, both of Fed. Rep. of Germany

[73] Assignee: W. Schlafhorst & Co., Mönchen-Gladbach, Fed. Rep. of Germany

[21] Appl. No.: 917,473

[22] Filed: Jun. 21, 1978

Related U.S. Application Data

[63] Continuation of Ser. No. 726,731, Sep. 27, 1976, abandoned.

[30] Foreign Application Priority Data

Sep. 27, 1975 [DE] Fed. Rep. of Germany ..... 2543281

[51] Int. Cl.[2] ..... B65H 63/02; B65H 63/08

[52] U.S. Cl. ..... 242/37 R; 242/35.5 R; 242/35.6 R; 242/39

[58] Field of Search ..... 242/39, 36, 37, 38, 242/35.5 R, 35.5 A, 35.6 R

[56] References Cited

U.S. PATENT DOCUMENTS 3,081,046 3/1963 Barnes, Jr. et al. ..... 242/36

*Primary Examiner*—George F. Mautz
*Attorney, Agent, or Firm*—Herbert L. Lerner

[57] ABSTRACT

Method of discontinuing operation of a winding device for textile coils after a thread break wherein the winding device has a winding cylinder whereon a coil to be wound rolls around, frictionally driven by the winding cylinder and an adjustable cut-off device responsive to a predetermined coil winding fullness, which includes in response to a thread break signal, rendering the cut-off device ineffective as well as inducing subsequent lifting of the coil away from the winding cylinder, and device for carrying out the foregoing method.

17 Claims, 3 Drawing Figures

METHOD AND DEVICE FOR DISCONTINUING OPERATION OF A WINDING DEVICE AFTER A THREAD BREAK OCCURS

This is a continuation of application Ser. No. 726,731, filed Sept. 27, 1976, now abandoned.

The invention relates to a method and device for discontinuing the operation of a winding device upon the occurrence of a thread break, wherein the winding device includes a winding cylinder whereon a coil to be wound rolls around and is frictionally driven by the winding cylinder, and an adjustable cut-off or disconnecting device responsive to a predetermined fullness of the winding being wound on the coil.

The obvious idea of having an existing cut-off device responsive to a predetermined coil winding fullness become effective also in the event of a thread break is not realizable from a practical standpoint without serious disadvantages. When employing a heretofore known cut-off device, the winding cylinder is initially uncoupled from the drive thereof and subsequently braked when a predetermined coil winding fullness has been attained. The fully wound coil, at that time continues to roll in accordance with the brake delay. During running down or slowing up of the coil, the thread is wound further on the coil in an orderly manner, such as cross layers, for example. The brake force is accurately matched to the coil winding fullness so that, on the one hand, the coil comes to rest as rapidly as possible and, on the other hand, no impermissible slip occurs between the coil and the winding cylinder.

If the same cut-off device were also to be used in the case of a thread break, the following difficulty arises:

The thread end is rolled into the surface of the coil and is able to be found only with great difficulty for the required knotting or typing operation.

If, on the other hand, it was desired to install the cut-off device so that, when the predetermined coil winding fullness is reached, the coil is simply lifted away from the winding cylinder, then no coordination exists any longer between the rotary speed of the coil and the speed of the thread guidance which leads to a thread entanglement or to a thread break. It was therefore necessary to sever the thread first and only then lift the coil. Severance of the thread is undesired, however, because the thread must then be rethreaded through the winding device anew at the beginning of the winding operation to be performed on the next coil.

It has been found in practice, as mentioned hereinbefore, that the discontinuance of a winding device by one and the same cut-off device at the occurrence of a thread break and when attaining a predetermined coil winding fullness is inexpedient and disadvantageous.

If the winding device or machine is furnished with automatic devices for coil exchange and for tying the thread after a thread break, further difficulties arise with the cut-off devices of the conventional type. When the winding device has stopped after fullness of the coil winding has been attained, only the coil exchanging device should be set into operation. The discontinuance in the operation of the winding device occurs after the coil exchange alone due to the coil exchange device. With a thread break, in contrast, only the knotting or tying device should be placed in operation. The discontinuance of the operation of the winding device occurs automatically after the knotting or tying of the thread only due to the knotting or tying device.

For these reasons also, the cut-off device responsive to a predetermined coil winding fullness is not permitted to be active or effective upon the occurrence of a thread break.

It is accordingly an object of the invention to provide a method and device for discontinuing operation of a winding device upon the occurrence of a thread break which avoids the foregoing disadvantages of heretofore known methods and devices of these general types and which permits fully undisturbed discontinuance of the operation of a winding machine after a thread break.

With the foregoing and other objects in view, there is provided, in accordance with the invention, a method of discontinuing operation of a winding device for textile coils after a thread break wherein the winding device has a winding cylinder whereon a coil to be wound rolls around, frictionally driven by the winding cylinder, and an adjustable cut-off device responsive to a predetermined coil winding fullness, which comprises, in response to a thread break signal, rendering the cut-off device ineffective as well as inducing subsequent lifting of the coil away from the winding cylinder. When employing the method of the invention, it is completely impossible for a suitably constructed cut-off device in any manner to disturbingly intervene in the lifting of the coil away from the winding cylinder. Such disturbances or disruptions are possible in that due to the lifting of the coil shortly before it reaches the maximal coil winding fullness, a greater coil winding fullness is only simulated or feigned and the coil exchanging device is set into operation at a false instant of time.

In accordance with another mode of the method of the invention, in response to the thread break signal, issuance of a demand signal for a coil exchange is blocked, and issuance of a least one signal selected from the group of signals consisting of a fault signal and a demand signal for automatically activating a fault-eliminating device is induced. The fault signal can be given acoustically or optically, for example. The demand signal can either be conducted by an electric line directly to the fault-eliminating device associated with this winding device alone or with several thereof in common or, for example, can be given in a manner that a switch pin at the winding device is driven out and releases the necessary switching operations for fault elimination at a fault-eliminating device which recurrently travels past the winding device.

In accordance with the device of the invention for performing the foregoing method thereof, the winding device has a winding cylinder whereon a coil to be wound is rollable around, frictionally driven by the winding cylinder, and a cut-off device responsive to a predetermined coil winding fullness, comprising means for issuing a thread break signal upon the occurrence of a break in a thread being wound on the coil, and means associated with the winding cylinder and responsive to the thread break signal for rendering the cut-off device ineffective as well as inducing subsequent lifting of the coil away from the winding cylinder. The rendering of the cut-off device ineffective and the lifting of the coil can occur by mechanically, electrically, pneumatically or hydraulically operating means.

Furthermore or additionally, in accordance with another feature of the invention, means are provided responsive to the thread break signal for blocking issuance of a demand signal for a coil exchange and for inducing issuance of at least one signal selected from the group of signals consisting of a fault signal and a demand signal for automatically activating a fault-eliminating device. Such a device can also operate with mechanically, electrically, pneumatically or hydraulically functioning means.

In accordance with a further feature of the invention, the winding device has a winding mandrel for the coil being wound, drive means for the winding cylinder, and a clutch for engaging the drive means to drive the winding cylinder, and including switching means, means for braking the winding mandrel, and means for braking the winding roller, the switching means being responsive to the thread break signal for engaging the brake means for the winding mandrel and/or disengaging the clutch for the drive means of the winding cylinder. When applying the brakes, the rotating parts come to a stop very rapidly so that the operation of the fault-elimination is shortened. The switching device of the invention can also be formed of mechanically, electrically, pneumatically or hydraulically operating means, preferably electrically and mechanically operating means are installed.

In accordance with an added feature of the invention, the means for braking the winding mandrel comprise a brake directly engageable with the winding mandrel.

In accordance with an additional feature of the invention, the winding device has a coil holder, and the device of the invention includes a rod member articulatingly connected to the coil holder, and means for lifting the rod member a given distance out of every rod setting thereof. The lifting means may be actuatable either mechanically, electrically, pneumatically or hydraulically. The rod member in specific constructions of winding devices, is already present in the form of a piston rod of an hydraulic damping device such as a dashpot. With the rod member and the coil holder, the coil per se is also lifted a given distance.

In accordance with yet another feature of the invention, the rod member is disposed coaxially or concentrically to the rod-member lifting means, and the device of the invention includes an unipartite or multipartite ring member pressable against the surface of the rod member and, in common with the rod member, being shiftable in longitudinal direction of the rod member. Such a device according to the invention ensures a symmetrical application of force to the rod member. The ring member can be formed of suitable adequately elastic and thereby pressure-tight material, such as polyamide or steel. Also, when the ring member is of unipartite construction, it is advantageously slit.

In accordance with another feature of the invention, the ring member is formed of a plurality of individual spherical components. These individual components can be disposed loosely as a ball ring or in a suitable manner can be mutually suspended by bridges, holders or the like.

In accordance with a further feature of the invention, the ring member as well as the rod member is coaxial or concentric to and surrounded by the rod-member lifting means, the lifting means having a pot-like housing formed with a base, and including a piston-cylinder assembly fluidically i.e. hydraulically or pneumatically, actuatable for applying compressive force to the ring member and the housing base. The piston-cylinder assembly is in a position to exert radially and axially directed forces on the ring, as viewed with respect to the longitudinal axis of the rod member. As a reaction force of the axially directed force components, a force action is produced on the housing base that can be used for further switching operations.

In accordance with an added feature of the invention, the piston-cylinder assembly comprises a ring-shaped piston and a cylinder formed with a ring groove in which the piston is received. The piston or the cylinder is fastened to the housing base or is integral therewith.

In accordance with an additional feature of the invention, the piston-cylinder assembly comprises at least one wall having a conical surface and movable in longitudinal direction of the rod member, the conical surface of the wall being engageable with the ring member, the ring member and the rod member being relatively movable and, during relative movement of the ring member with respect to the rod member in direction toward the coil holder, the ring member pressing against the surface of the rod member and simultaneously lifting the rod member.

In accordance with yet another feature of the invention, the conical wall surface is defined by part of the cylinder formed with the ring groove.

In accordance with yet a further feature of the invention, the winding device has a framework, and the device of the invention includes a frame connected with the framework of the winding device, the housing being mounted in the frame, a resilient member disposed between the base of the housing and a lower part of the frame, the resilient member, in a condition thereof wherein the resilient member is unstressed by the weight of a coil being wound, spacing the base of the housing a predetermined distance apart from the lower part of the frame. This feature of the invention has the objective of permitting a movement of the housing base against the lower part of the frame with actuation of the piston-cylinder assembly, before the coil is lifted away from the winding cylinder. The movement begins at the instant when the weight of the coil beyond that of the coil holder, the rod member, the ring member, the cylinder, the hydraulic or pneumatic pressure medium, the piston and the base of the housing beings to have an effect upon the resilient member. Due to the elasticity of the coil, the latter has not yet, at that time, been lifted away from the winding cylinder. The downwardly directed movement of the housing is advantageously employed for a switching operation in accordance with a concomitant feature of the invention wherein the device of the invention includes a common stop adjusting device operatively associated with the frame and the housing, a stop carried by the cut-off device responsive to the coil winding fullness, the stop adjusting device being operative in a condition when the base of the housing approaches the lower part of the frame for blocking the stop so that the cut-off device is rendered ineffective. This feature of the invention thereby prevents the cut-off device responsive to the coil winding fullness from acting before the device for discontinuing the operation which is responsive to the thread break. The cut-off device responsive to the coil winding fullness receives the cut-off signal for the most part when the coil holder has reached a predetermined angular position. Since the lifting of the coil holder is caused by the thread break signal, a greater coil winding fullness is simultaneously feigned or simulated so that the rendering-ineffective of the cut-off device responsive to the coil winding fullness, in accordance with the invention, at the occurrence of a thread break shortly before the maximal coil winding fullness has been attained is of special advantage.

As a further advantage of the invention, it should be emphasized that the reengagement of the winding device after the elimination of the thread break without trouble due to an automatic fault-eliminating device, such as a knotter or tying device, for example, can be effected also in automatic winding machines, while a demand for a coil exchange is prevented.

Other features which are considered as characteristic for the invention are set forth in the appended claims.

Although the invention is illustrated and described herein as embodied in a method and device for discontinuing operation of a winding device when the thread breaks, is is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
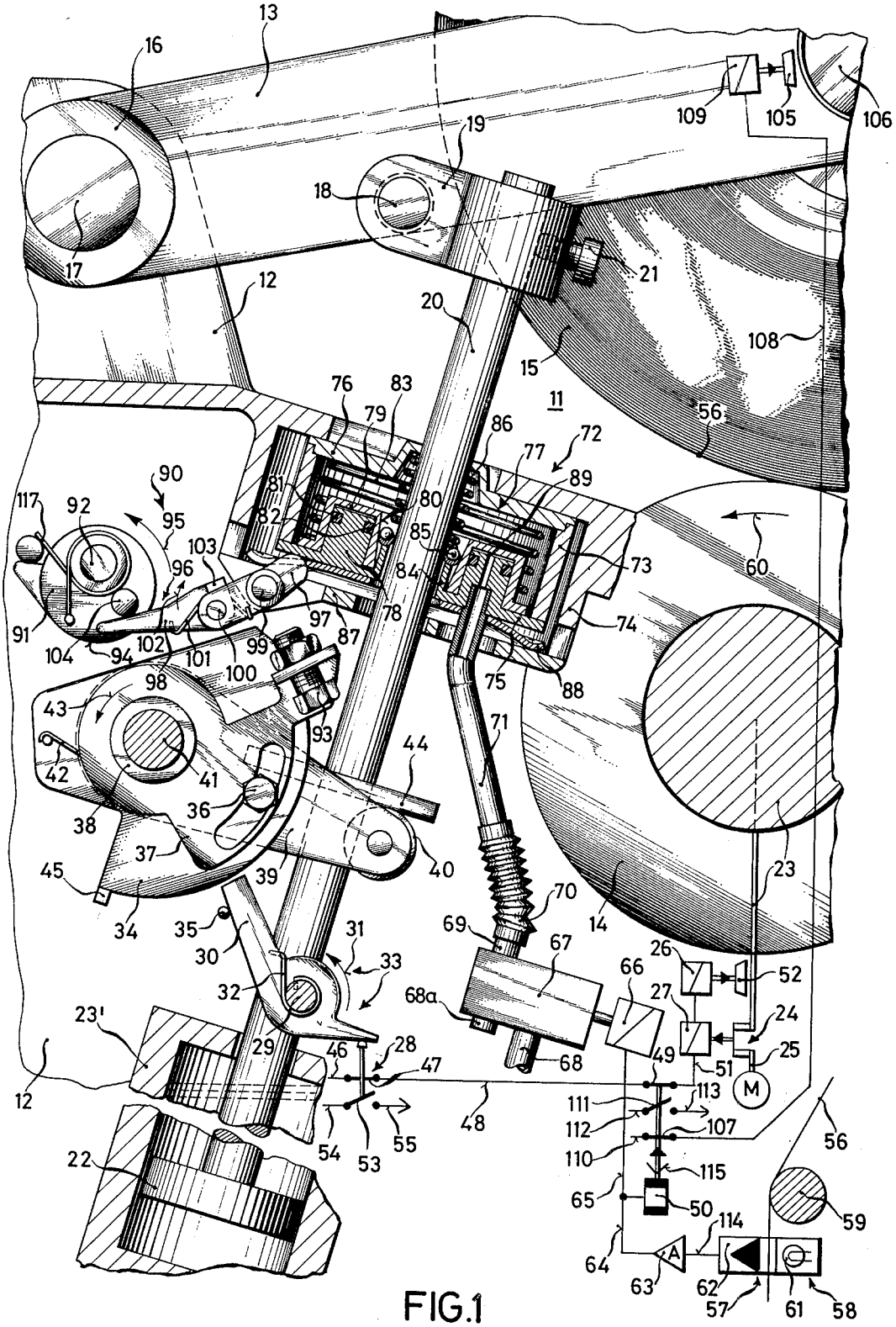
FIG. 1 is a side elevational view, partly in section and partly schematic, of a device for discontinuing operation of a winding device at breaking of the thread in state of rest.
Figure 2:
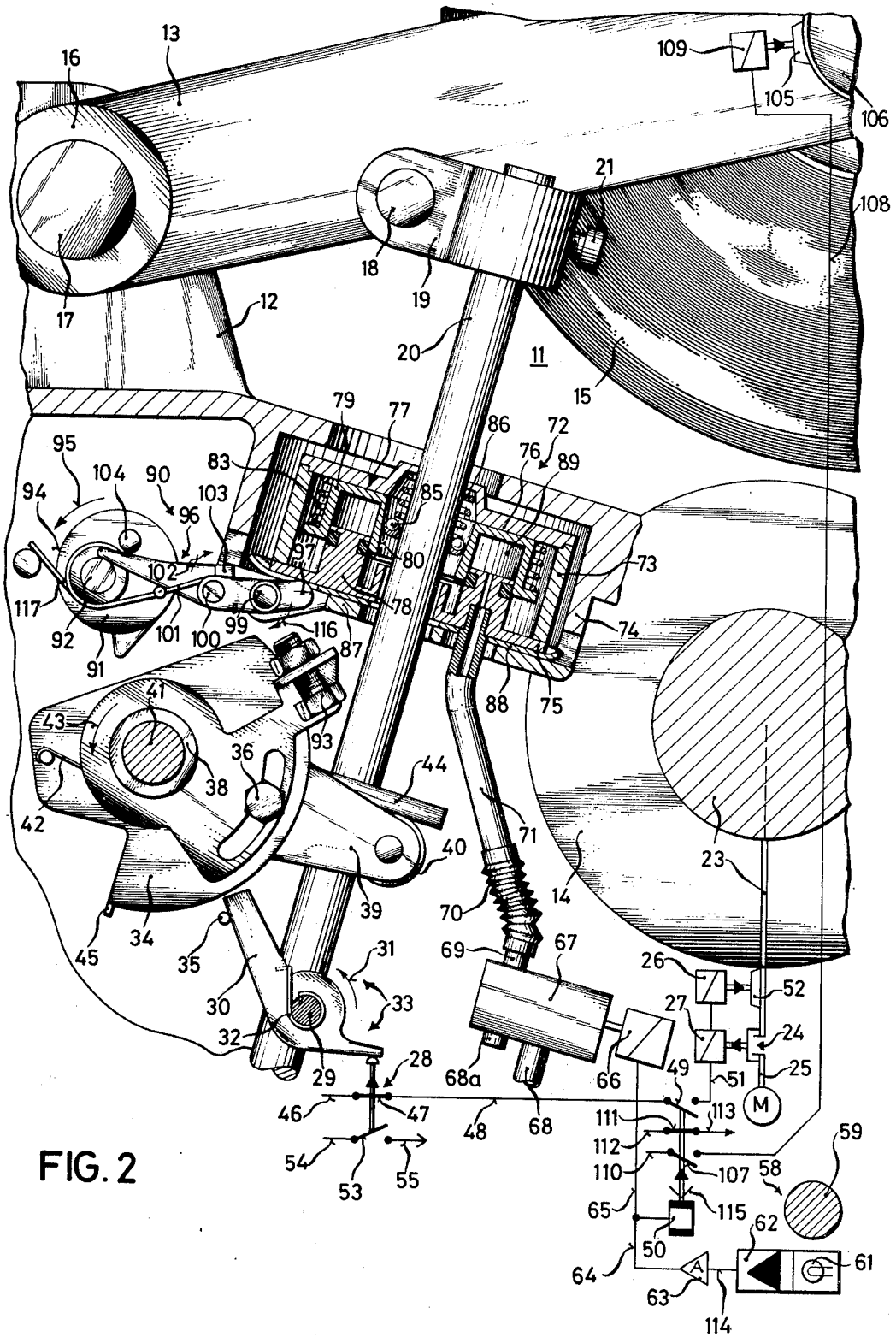
FIG. 2 is another view of FIG. 1 showing the device in an operating phase thereof wherein the coil is lifted by the winding cylinder.

Referring now to the drawings and first, particularly to FIGS. 1 and 2 thereof, there is shown a winding device 11 for textile coils which has a machine frame 12, a coil holder 13 and a winding cylinder 14 for winding a thread 56 on a coil 15. The coil holder 13 possesses a bushing 16 which is rotatably mounted on a shaft 17 connected to the machine frame 12. In addition, the coil holder 13 has a pin 18 on which a bracket or clamp 19 is articulatingly fastened. A rod 20 is held by the clamp 19 with the aid of a clamping screw 21. The rod 20 serves as a piston rod for a piston 22 of an oil dashpot 23' which is articulatingly connected at the non-illustrated end thereof to the machine frame 12.

The winding cylinder 14 is driven by a motor M through a shaft 23, a magnetic clutch 24 and a shaft 25.

There is additionally shown in FIGS. 1 and 2 an adjustable automatic cut-off or disconnecting device 33 responsive to a predetermined fullness of winding on the coil 15. The disconnection or cut-off proper is effected by switching off a brake-lifting or releasing magnetic drive 26 and a clutch magnetic drive 27 of the magnetic clutch 24 by means of a switch 28 belonging to the cut-off or disconnecting device 33. The cut-off device 33 has, in addition, a pawl 30 which is loaded or stressed in direction of the arrow 31 by a prestressed spring 32. The pawl 30 is held back by a stop 35. A disc 34 provided with a stop 45 is connected by a set screw 36 with an adjusting disc 37. The adjusting disc 37 is fastened by a bushing 38 to a lever 39 which carries a tactile roller 40 at an end thereof. The bushing 38 of the adjusting disc 37 is rotatably mounted on a stationary pin 41. The adjusting disc 37 per se is loaded or stressed by a wound bending spring 42 in direction of the arrow 43, so that the tactile roller 40 presses continuously from below, as viewed in FIG. 1 for example, against a collar 44 fastened to the rod 20. Upon lifting of the rod 20 due to the increasing diameter of the coil 15, then the lever 39, the adjusting disc 37 and the disc 34 rotate in direction of the arrow 43 until the pawl 30 engages the stop 45, rotates opposite to the direction of the arrow 31 and switches over the switch 28. This is the case when reaching a specific diameter of the coil 15 adjustable by the set screw 36.

After the cut-off device 33 has responded in this manner, the cut-off per se of the winding device occurs by stopping the winding cylinder 14 as the current supply from the line 46 over the contact 47 of the switch 28, the line 48, the contact 49 of the relay 50 and the line 51 to the electromagnetic drives 26 and 27 is interrupted by the opening contact 47. The electromagnetic drives 26 and 27 thereby become currentless so that the weakly acting brake 52 places itself against the shaft 23 and the magnetic clutch 24 disengages. As the rotary speed of the winding cylinder 14 reduces, the winding speed of the coil 15 becomes slower. Finally, the winding cylinder 14 and the coil 15 come to a stop. The cut-off operation upon attainment of the predetermined fullness of the coil is thereby ended.

Upon response of the switch 28, the contact 53, in addition, closes whereby a current from the line 54 flows through the line 55 to a non-illustrated device which calls for a coil exchange. The latter device includes, in the simplest form thereof, an optical or acoustic signaling or indicating device for the servicing or operating personnel. In automatic winding machines, an indicating signal travels over the line 55 to a stationary coil exchanger or, in a shuttle operation, an automatic coil exchanger servicing several winding stations sequentially.

It is apparent from FIG. 1 that the thread 56 to be wound runs in direction of the arrow 57 through a thread monitor 58 and over a deflector 59, if necessary over further deflecting locations and thread guide members that are non-illustrated, however, between the winding cylinder 14, which is rotating in direction of the arrow 60, and the coil 15 and onto the coil 15. The winding cylinder 14 per se can be constructed as a thread guidance member and, for example, can conduct the thread in crossed layers onto the coil 15 through thread guidance grooves.

The thread monitor 58 has an electric light source 61 and a photoelectric element or cell 62 that is connected through an amplifier 63 and a line 64 to the coil of the relay 50, which serves as switching device, and through a further line 65 to an electromagnetic drive 66 of a pneumatic three-way valve 67. The valve 67 has an inlet tube 68 coming from a pressure source, a venting tube **68*a* and an outlet tube 69 leading through a flexible line 70 and a tube 71 to a device 72 which serves for rendering inoperative the cut-off or disconnecting device 33 responsive to a predetermined fullness of coil winding and for subsequently lifting the coil 15 from the winding cylinder 14**.

The device 72 has a housing 73 which is disposed centrically or substantially coaxially about the rod 20 and extends loosely through a frame 74 which is integral with the the machine frame 12. The housing 73 is closed by a cover 76. In the interior of the housing 73, a piston-cylinder assembly 77 is located. The base 75 of the housing 73 is integral with the piston 78, which is circular. Above the piston 78 is located a cylinder 79 in the form of a circular groove, which has a conical outer wall surface 80 facing toward the rod 20.

Two sealing rings 81 and 82 assume the sealing action between the piston 78 and the cylinder 79. The cylinder 79 is held down by a compression spring 83 in the state of rest of the device 11. On a ring 84 integral with the base 75, a multipartite ring 85 formed of steel balls rests with slight play against the conical outer wall surface 80 or the rod 20. The ring 85 is held down by a compression spring 86.

A resilient element 88 having the form of a leaf spring is disposed between the base 75 of the housing 73 and the lower part 87 of the frame 74. The line 71 terminates in the circular inner chamber 89 of the cylinder 79.

A common stop adjusting device 90 is associated with the frame 74 and the housing 73. The stop adjusting device 90 has an adjustable eccentric disc 91, which is provided with slight self-retarding action and is disposed about a pin 92. A set screw 93 is fastened to the adjusting disc 37 so that the set screw 93, during the progressive rotary motion thereof with increasing fullness of the coil winding, strikes against the edge 94 of the eccentric disc 91 before the pawl 30 can contact the stop 45 of the disc 34, inasmuch as the eccentric disc 91 is shifted so far in direction of the arrow 95 as is shown in FIG. 2. In the position of the eccentric disc 91 shown in FIG. 1, contrarily, the pawl 30 contacts the stop 45 of the disc 34 before the set screw 93 reaches the edge 94 of the eccentric disc 91. As long as the set screw 93, if necessary, presses against the edge 94 of the eccentric disc 91, the latter cannot then be set back to the rest position shown in FIG. 1 because of the existing slight self-retarding action, when the lever 96 assumes the rest position shown in FIG. 1.

The lever 96 is of bipartite construction. The part 97 is mounted for rotation about the pin 99 which is fastened to the frame 74. One end of the part 97 engages the base 75 of the housing 73. The other end of the part 97 carries a knuckle joint 100 to which the other part 98 of the lever 96 is fastened. The lever part 98, loaded by a spring 101 in direction of the arrow 102, engages the lever part 97 by means of a stop 103. Opposite to the direction of the arrow 102, the lever part 98 can, contrarily, snap off in the knuckle joint 100. The force of the spring 101 is so great that a snapping-off of the lever part 98 in the knuckle joint 100 occurs only if it has rotated the eccentric disc 91 with the aid of a stop pin 104 so far in direction of the arrow 98 as shown in FIG. 2.

In the arrangement of the relay 50, a switching device responsive to the thread-breaking signal is associated with the winding device 11 for switching on or engaging a weakly acting brake 105 for the winding mandrel 106 of the coil 15, the similarly weakly acting brake 52 for the winding cylinder 14 and for disengaging the clutch 24 for the winding cylinder drive (the motor M, the shaft 25). The disengagement of the magnetic clutch 24 and the engagement of the brake 52 is caused by opening the contact 49 whereby the brake-releasing magnetic drive 26 and the clutch magnetic drive 27 become currentless. The engagement of the brake 105 is caused by opening the contact 107, whereby the line 108 and therewith also the brake-releasing magnetic drive 109 from the line 110 leading to a voltage source is switched off. The relay 50 serves also as a device for the output of a fault signal and a demand signal for an automatic fault-eliminating device, not illustrated in the drawings, such as a knotting device, for example. This occurs through closing the contact 111 whereby a signal current flows from the line 112 through the line 113 to a non-illustrated device which signals a fault and calls for a fault-eliminating device.

In FIG. 1, the winding device 11 is shown in undisturbed winding operation. The contact 47 of the switch 28 and the contact 49 of the relay 50 are closed so that the brake-releasing magnetic drive 26 and the clutch magnetic drive 27 are switched on. The clutch 24 is therefore engaged and the brake 52 released. The motor M rotates the winding cylinder 14 in direction of the arrow 60 through the shaft 25, the clutch 24 and the shaft 23. The coil 15 rolls on the winding cylinder 14 and is driven thereby through friction. The contact 107 of the relay 50 is closed. A current therefore flows from the line 110 through the line 108 to the brake-releasing magnetic drive 109 so that the brake 105 is released. The thread 56 runs between the light source 61 and the photoelectric device 62 of the thread monitor 58 in direction of the arrow 57 over the deflector 59 and further non-illustrated deflecting or diverting locations, guided through the winding cylinder 14, onto the coil 15. In the three-way valve 67, the outlet tube 69 is connected to the venting tube 68*a*.

The instant a thread break occurs, according to FIG. 2, the thread monitor 58 supplies or interposes a thread break signal which travels over the line 114 to the amplifier 63. The amplified thread break signal is then conducted over the line 64 to the coil of the relay 50 and over the line 65 to the electromagnetic drive 66 of the pneumatic three-way valve 67. The valve 67 connects the outlet tube 69 to the inlet tube 68 and compressed air flows from the inlet tube 68 through the tube 71 into the inner chamber 89 of the cylinder 79 of the piston-cylinder assembly 77. The cylinder 79 is then lifted against the force of the compression spring 83, entrains the ring 85 and clamps it firmly between the conical outer wall surface 80 and the surface of the rod 20. With further expansion of the pressure medium, the weight of the coil holder 13 and the coil 51 begins to press upon the rod 20 without the coil 15 first losing the contact thereof with the winding cylinder 14. This results in the resilient elements 88 becoming pressed together until the elements 88 are pressed flat as shown in FIG. 2. In the interim, the lever 96 is rotated in direction of the arrow 116 about the pin 99 due to the descending base 75 of the housing 73, whereby the part 98 of the lever 96 lifts the stop pin 104 so that the eccentric disc 91 is rotated against the force of the spring 117 in direction of the arrow 95. Parts of the edge 94 located farther removed from the pin 92 thereby arrive within the pivot path of the set screw 93 so that, upon further rotation of the disc 34 in direction of the arrow 43, the stop screw 93 strikes against the edge 94 of the eccentric disc 91 before the pawl 30 can engage the stop 45 of the disc 34. Since the disc 34 cannot then rotate further, the cut-off device 33 responsive to a predetermined coil winding fullness has been inactivated. The switch 28 of the cut-off device 33 cannot be actuated, the contact 53 cannot close and the issuance of a demand signal for a coil exchange is automatically prevented.

The instant the spring or resilient element 88 is pressed flat, the cylinder 79, during further expansion of the pressure medium, slides up to and against the cover 76 of the housing 73 and lifts the coil 15 from the winding cylinder 14 through the ring 85, the rod 20 and the coil holder 13, as shown in FIG. 2.

When the electromagnetic drive 66 is switched on, the coil of the relay 50 is simultaneously energized through the line 64. The relay 50 has a switching-delay device 115 so that only after the passage of a delay period does a switch-over from the switching condition shown in FIG. 1 to the switching condition shown in FIG. 2 occur.

The delay time period is calculated so that the switch-over of the relay 50 occurs after the instant the coil 15 has been lifted from the winding cylinder 14. The contact 49 is thus opened, resulting in the uncoupling and braking of the shaft 23. The contact 107 is also opened with the result that the winding mandrel 106 is braked. The contact 111 becomes closed, whereby a demand signal for an automatic fault-eliminating device and, simultaneously, a fault signal are issued. After the winding cylinder 14 and the coil 15 have stopped rotating, a fault-eliminating device can then be actuated and, after eliminating the thread break, causes the renewed start-up of the winding device.

Figure 3:
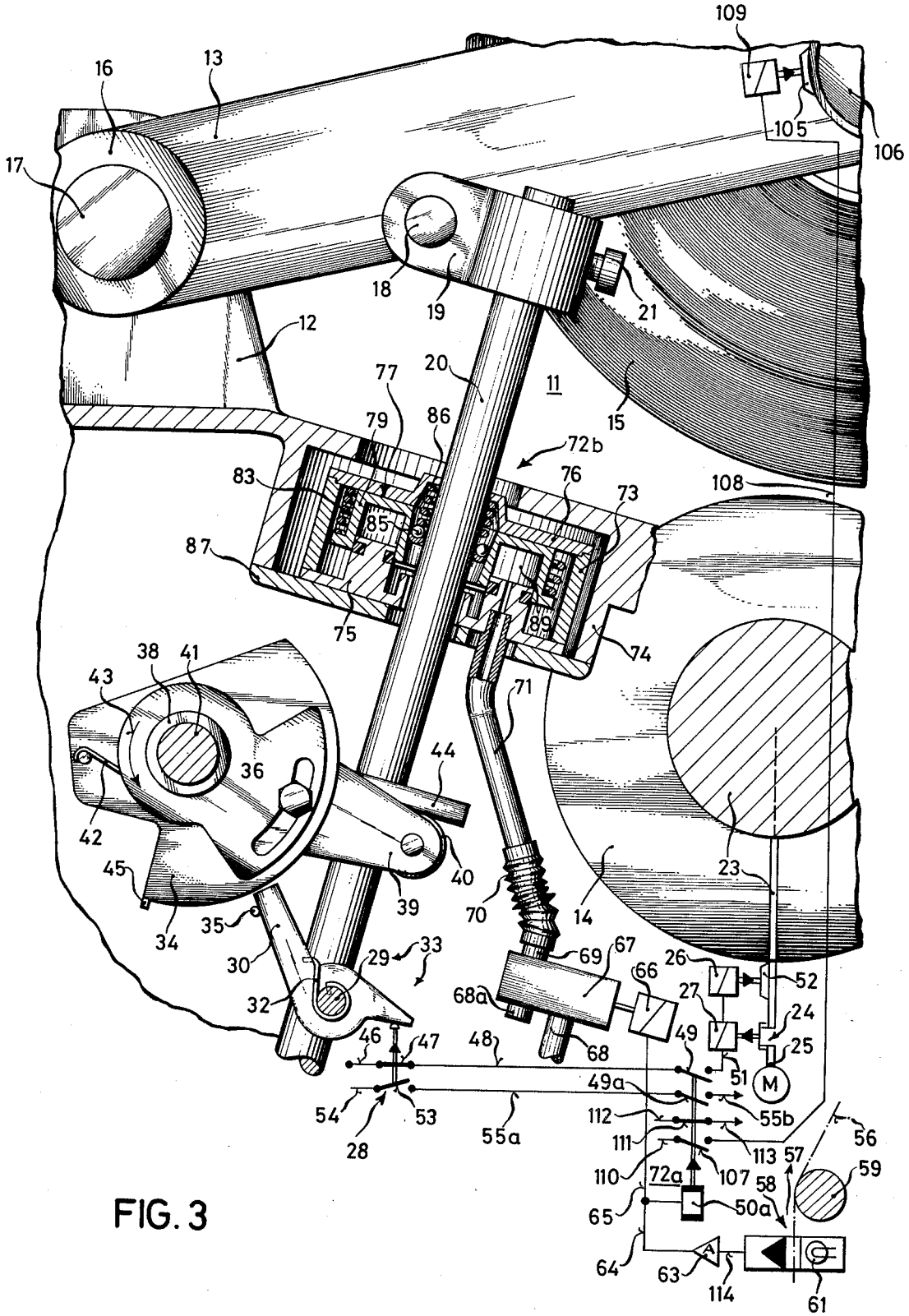
FIG. 3 is a view similar to that of FIG. 1 of another embodiment of the invention.

FIG. 3 shows a somewhat modified embodiment of the invention. The thread monitor 58 with the light source 61 and the photoelectric element 62, the amplifier 63, the pneumatic three-way valve 67, the piston-cylinder assembly 77 and the cut-off device 33 responsive to a predetermined coil winding fullness are readily noted in FIG. 3. All of these parts are the same as those identified by like reference numerals in FIGS. 1 and 2.

The device **72*a* to inactivate the cut-off device 33 responsive to a predetermined coil winding fullness is spatially and functionally separated from the device 72*b* for subsequently lifting the coil 15 from the winding cylinder 14**.

Upon the occurrence of a break in the thread 56, the thread monitor 58 issues a thread-break signal which travels over the line 114 to the amplifier 63. The amplified thread-break signal is conducted over the line 64 to the coil of the relay **50*a* and over the line 65 to the electromagnetic drive 66 of the pneumatic three-way valve 67**.

The valve 67 connects the outlet tube 69 to the inlet tube 68, and compressed air flows from the inlet tube 68 through the tube 71 into the cylinder inner chamber 89 of the piston-cylinder assembly 77. The further function of the piston-cylinder assembly 77 of the embodiment of FIG. 3 is the same as for the embodiment of FIGS. 1 and 2 except that the lifting of the coil 15 through the rod 20 begins immediately because the resilient element 88 is omitted and the base 75 of the housing 73 already from the very beginning lies on the lower part 87 of the frame 74. A stop-adjusting device is not provided in the embodiment of FIG. 3.

When the electromagnetic drive 66 is switched on, the coil of the relay **50*a* is simultaneously energized through the line 64. The relay 50*a* switches-over immediately and without delay into the switching position shown in FIG. 3. Due to the then undelayed switch-over, the relay 50*a*, in the embodiment of FIG. 3, serves in a similar manner as the device 72*a* responsive to the thread-break signal for inactivating the cut-off device 33, as device for preventing the issuance of a demand signal for a coil exchange, as device for issuing a fault signal and demand signal for an automatic fault-eliminating device, and as switching or shifting device for engaging the brake 105 for the winding mandrel 106 of the coil 15, the brake 52 for the shaft 23 of the winding cylinder 14 and for switching on or engaging the electromagnetic clutch 24 for the drive (the shaft 25 and the motor M) of the winding cylinder 14**.

The switch 28 of the cut-off device 33 is inactivated by the fact that the contact 49 opens and the connection of the line 48 to the line 51 is broken and that, simultaneously, the contact **49*a* located between the partial lines 55*a* and 55*b* also opens so that issuance of a demand signal for a coil exchange over the line 55*b*** is prevented.

Inasmuch as the thread break occurs shortly before attainment of the adjusted maximal coil winding fullness, and the pawl 30 engages the stop 45 of the cam disc 34 with the lifting of the rod 20, and the switch 28 switches over then, beforehand, through the undelayed opening of the contacts 49 and **49*a*, the switch 28 belonging to the cut-off device 33 has already been made ineffective. The relay 50 switches over before the rod 20 is lifted because excess pressure must first be built up in the cylinder inner chamber 89 of the piston-cylinder assembly 77 before the cylinder can succeed in moving and can entrain the ring only in the course of movement thereof and can press against the rod 20**.

The embodiment of FIG. 3 has the advantage that the lifting of the coil 15 from the winding cylinder 14 takes place more rapidly than with the embodiment of FIGS. 1 and 2 and, in fact, so rapidly that the coil 15 has already been lifted before the thread end arrives at the contact point between the winding cylinder 14 and the coil 15. The thread end can therefore not be fulled into the surface of the coil 15, although the brakes 52 and 105 already, albeit only weakly, act before the coil 15 is lifted. Through the immediate engagement of the brakes, the winding device, upon occurrence of a thread break, is more rapidly taken out of operation in a desired manner than with the embodiment of FIGS. 1 and 2.

Upon the closing of the contact 111, the current conducting line 112 is connected to the line 113 over which thereby a demand signal for an automatic fault-eliminating device and, simultaneously, a fault signal are issued.

The embodiment according to FIG. 3 has the further advantage of greater simplicity in the construction thereof.

There are claimed:

1. Method of discontinuing operation of a winding device for textile coils after a thread break, the winding device having a winding cylinder for frictionally driving a coil to be wound, means for disconnecting the operation of the winding device, adjustable means operatively connected to the coil for actuating said disconnecting means in response to a predetermined coil winding fullness and means activated by said disconnecting means for stopping the driving of the winding cylinder and for issuing a demand signal for a coil exchange, which comprises, in response to a thread break signal, rendering the disconnecting means ineffective, stopping the driving of the winding cylinder and rotation of the coil and subsequently inducing lifting of the coil away from the winding cylinder.

2. Method according to claim 1 which further comprises, in response to the thread break signal, inducing issuance of at least one signal selected from the group of signals consisting of a fault signal and a demand signal for automatically activating a fault-eliminating device.

3. In a device for carrying out a method of discontinuing operation of a winding device for textile coils after a thread break, the winding device having a winding cylinder for frictionally driving a coil to be wound, means for disconnecting the operation of the winding device, means operatively connected to the coil for actuating said disconnecting means in response to a predetermined coil winding fullness and means activated by said disconnecting means for stopping the driving of the winding cylinder and for issuing a demand signal for a coil exchange, means for issuing a thread break signal upon the occurrence of a break in a thread being wound on the coil, means associated with said actuating means and responsive to the thread break signal for rendering the disconnecting means ineffective and for inducing subsequent lifting of the coil away from the winding cylinder and including means responsive to the thread break signal for stopping the driving of the winding cylinder and the rotation of the coil and for inducing issuance of at least one signal selected from the group of signals consisting of a fault signal and a demand signal for automatically activating a fault-eliminating device.

4. In a device for carrying out a method of discontinuing operation of a winding device for textile coils after a thread break, the winding device having a winding cylinder for frictionally driving a coil to be wound, means for disconnecting the operation of the winding device, means operatively connected to the coil for actuating said disconnecting means in response to a predetermined coil winding fullness and means activated by said disconnecting means for stopping the driving of the winding cylinder, means for issuing a thread break signal upon the occurrence of a break in a thread being wound on the coil, means associated with said actuating means and responsive to the thread break signal for rendering the disconnecting means ineffective and for inducing subsequent lifting of the coil away from the winding cylinder, the winding device having a winding mandrel for the coil being wound, drive means for the winding cylinder, and a clutch for engaging the drive means to drive the winding cylinder, and including switching means, means for braking the winding mandrel, and means for braking the winding cylinder, said switching means being responsive to the thread break signal for engaging said means for braking said winding mandrel and said winding cylinder.

5. Device according to claim 4 wherein said means for braking the winding cylinder comprise means for disengaging the clutch for the drive means of the winding cylinder.

6. Device according to claim 4 wherein said means for braking the winding mandrel comprise a brake directly engageable with the winding mandrel.

7. In a device for carrying out a method of discontinuing operation of a winding device for textile coils after a thread break, the winding device having a winding cylinder for frictionally driving a coil to be wound, means for disconnecting the operation of the winding device, means operatively connected to the coil for actuating said disconnecting means in response to a predetermined coil winding fullness and means activated by said disconnecting means for stopping the driving of the winding cylinder, comprising means for issuing a thread break signal upon the occurrence of a break in a thread being wound on the coil, means associated with said actuating means and responsive to the thread break signal for rendering the disconnecting means ineffective and for inducing subsequent lifting of the coil away from the winding cylinder.

8. Device according to claim 7 wherein the winding device has a coil holder, and including a rod member articulatingly connected to the coil holder, and means for lifting said rod member a given distance.

9. In a device for carrying out a method of discontinuing operation of a winding device for textile coils after a thread break, the winding device having a winding cylinder for frictionally driving a coil to be wound, means for disconnecting the operation of the winding device, means operatively connected to the coil for actuating said disconnecting means in response to a predetermined coil winding fullness and means activated by said disconnecting means for stopping the driving of the winding cylinder, comprising means for issuing a thread break signal upon the occurrence of a break in a thread being wound on the coil, means associated with said actuating means and responsive to the thread break signal for rendering the disconnecting means ineffective and for inducing subsequent lifting of the coil away from the winding cylinder, the winding device having a coil holder, and including a rod member articulatingly connected to the coil holder, and said means for inducing lifting of the coil including means for lifting said rod member a given distance, said rod member being disposed coaxially to said rod member lifting means, and including a ring member pressable against the surface of said rod member and, in common with said rod member, being shiftable in longitudinal direction of said rod member.

10. Device according to claim 9 wherein said ring member is multipartite.

11. Device according to claim 10 wherein said ring member is formed of a plurality of individual spherical components.

12. Device according to claim 9 wherein said ring member and said rod member are coaxial to and surrounded by said rod-member lifting means, said lifting means having a pot-like housing formed with a base, and including a piston-cylinder assembly fluidically actuatable for applying compressive force to said ring member and said housing base.

13. Device according to claim 12 wherein said piston-cylinder assembly comprises a ring-shaped piston and a cylinder formed with a ring groove in which said piston is received.

14. Device according to claim 12 wherein said piston-cylinder assembly comprises at least one wall having a conical surface and movable in longitudinal direction of said rod member, said conical surface of said wall being engageable with said ring member, said ring member and said rod member being relatively movable and, during relative movement of said ring member with respect to said rod member in direction toward the coil holder, said ring member pressing against the surface of the rod member and simultaneously lifting the rod member.

15. Device according to claim 14 wherein said conical wall surface is defined by part of said cylinder formed with said ring groove.

16. Device according to claim 12 wherein the winding device has a framework, and including a frame connected with the framework of the winding device, said housing being mounted in said frame, a resilient member disposed between said base of said housing and a lower part of said frame, said resilient member, in a condition thereof wherein said resilient member is unstressed by the weight of a coil being wound, spacing said base of said housing a predetermined distance apart from said lower part of said frame.

17. Device according to claim 16 in which said means for rendering the disconnecting means ineffective includes a stop adjusting device operatively associated with said frame and said housing, a stop carried by said actuating means responsive to the coil winding fullness, said stop adjusting device being operative in a condition when said base of said housing approaches said lower part of said frame for blocking said stop so that said disconnecting means is rendered ineffective.

* * * * *